US006715182B2

(12) United States Patent
Cheng

(10) Patent No.: US 6,715,182 B2
(45) Date of Patent: Apr. 6, 2004

(54) SELF-CLOSING SAFETY GATE HINGE

(76) Inventor: Shu-Chen Cheng, 3 Fl., No. 100, Wen-Lin N. Rd., Taipei (TW)

( * ) Notice: Subject to any disclaimer, the term of this patent is extended or adjusted under 35 U.S.C. 154(b) by 0 days.

(21) Appl. No.: 10/188,978

(22) Filed: Jul. 5, 2002

(65) Prior Publication Data

US 2003/0009945 A1 Jan. 16, 2003

(30) Foreign Application Priority Data

Jul. 11, 2001 (TW) ..... 90211643 U

(51) Int. Cl.[7] ..... E05F 1/08; E04H 17/00

(52) U.S. Cl. ..... 16/280; 16/50; 16/86.1; 16/303; 16/72; 16/DIG. 10; 256/65.01

(58) Field of Search ..... 16/50, 86.1, 86.2, 16/280, 284, 303, 308, 72, DIG. 10; 256/65.01, 26, 67, 73

(56) References Cited

U.S. PATENT DOCUMENTS 309,039 A * 12/1884 Foster ..... 16/316
612,471 A * 10/1898 Wood ..... 16/318
3,398,487 A * 8/1968 Matyas ..... 16/312
4,030,161 A * 6/1977 Loikitz ..... 16/284
4,215,449 A * 8/1980 Loikitz ..... 16/50
4,697,306 A * 10/1987 Rhodes ..... 16/317
4,978,014 A * 12/1990 Humitz et al. ..... 16/284
5,222,260 A * 6/1993 Piper ..... 16/303
5,715,576 A * 2/1998 Liu ..... 16/342
6,477,736 B1 * 11/2002 Abernathy ..... 16/72

* cited by examiner

*Primary Examiner*—Anthony Knight
*Assistant Examiner*—Christopher Boswell
(74) *Attorney, Agent, or Firm*—Rabin & Berdo, P.C.

(57) ABSTRACT

A self-closing safety gate hinge comprises a bracket, a bottom seat, a top seat and a hinge pin. The bracket is attached to a top of a gate post. The bottom seat is attached to one side of the bracket and an inclined top surface is cambered on the bottom seat. A through hole is defined vertically through the bottom seat. The top seat has an inclined bottom surface corresponding to the inclined top surface and is attached to one side of a gate at top. A stepped through hole is defined vertically through the top seat. The hinge pin is mounted through a spring and the through holes and is held in place by a C-clip.

8 Claims, 9 Drawing Sheets

SELF-CLOSING SAFETY GATE HINGE

BACKGROUND OF THE INVENTION

1. Field of the Invention

The present invention relates to a safety gate hinge, and more particularly to a self-closing safety gate hinge.

2. Description of Related Art

Generally, many parents install a safety gate at the top or bottom of stairs and in doorways to prevent their children from falling down the stairs or out of doors. Safety gates are especially important for the safety of toddlers and crawling infants.

With reference to FIG. 9, a conventional safety gate (60) is very easy to open, and children may inadvertently push the safety gate open when they are playing with potentially dangerous and disastrous results. Moreover, when people open the safety gate, they often forget to close it. If the safety gate does not have a self-closing capability, an infant that crawls or walks to the safety gate may be in danger of falling. The conventional safety gate is not safe enough.

To overcome the shortcomings, the present invention provides an improved safety gate hinge to mitigate and/or obviate the aforementioned problems.

SUMMARY OF THE INVENTION

The main objective of the invention is to provide an improved safety gate that can provide children a substantially safer living environment.

One embodiment of the self-closing safety gate hinge in accordance with the invention comprises a bracket, a bottom seat, a top seat and a hinge pin. The bracket is mounted at the top of a gate post and it has a side facing the safety gate. The bottom seat is attached to the side of the bracket facing the safety gate. The top surface of the bottom seat is inclined, and the inclined top surface is cambered from front to back. A vertical through hole is defined through a central position of the bottom seat. The top seat is mounted on the bottom seat and an inclined bottom surface corresponds to the inclined top surface on the bottom seat. The top seat is attached to one side of a gate body. A stepped vertical through hole is defined in a central position of the top seat to correspond to the vertical through hole in the bottom seat. A spring is mounted in the vertical through hole in the top seat. A hinge pin is mounted in the aligned vertical through holes through the spring and extends out of the vertical through hole in the bottom seat. A C-clip is mounted around the hinge pin and holds the hinge pin in the vertical holes. The hinge pin connects the top and bottom seat together.

Other objects, advantages and novel features of the invention will become more apparent from the following detailed description when taken in conjunction with the accompanying drawings.

DETAILED DESCRIPTION OF PREFERRED EMBODIMENT

Figure 1:
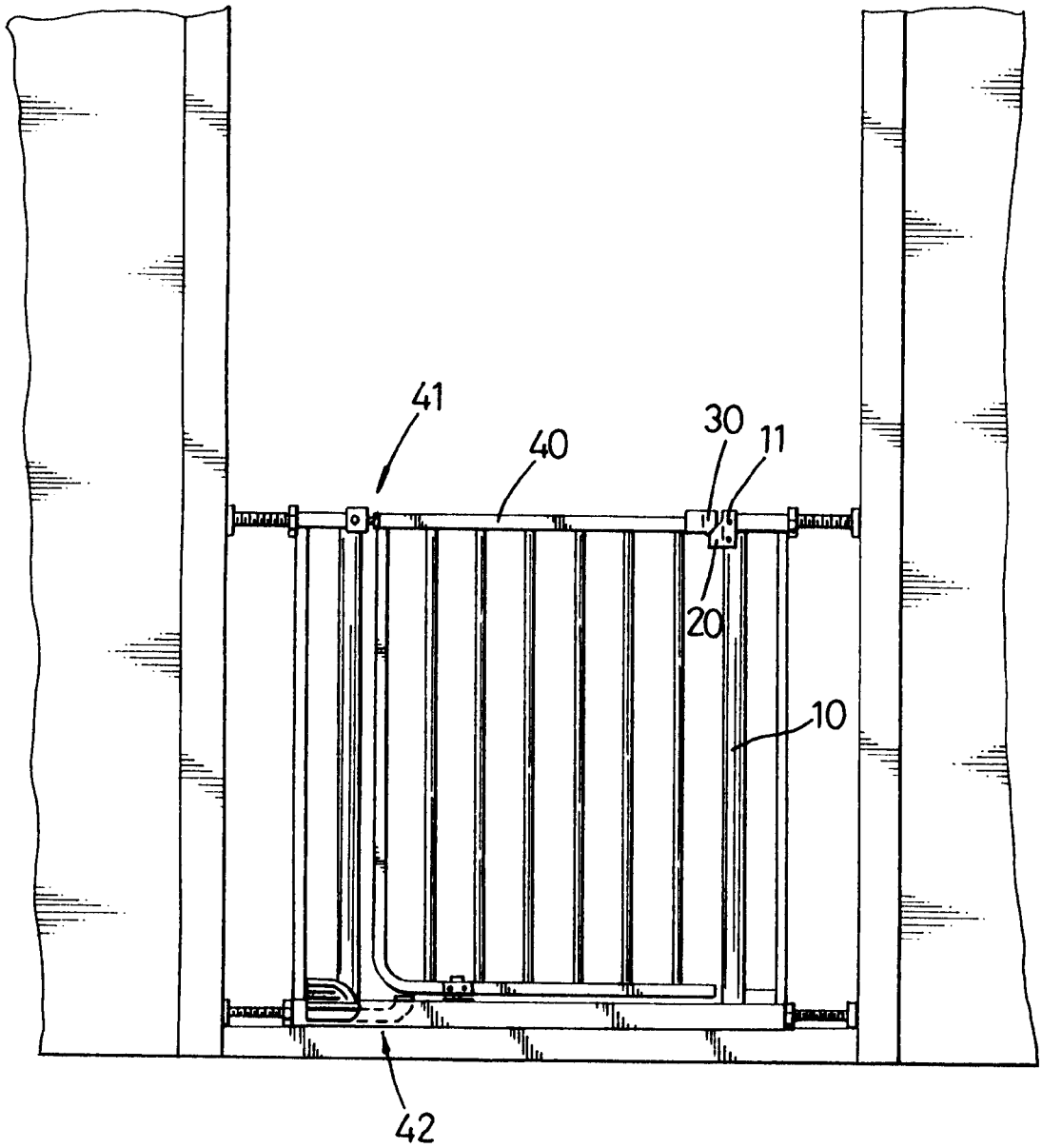
FIG. 1 is an operational front plan view of a safety gate with a self-closing safety gate hinge in accordance with the present invention.
Figure 2:
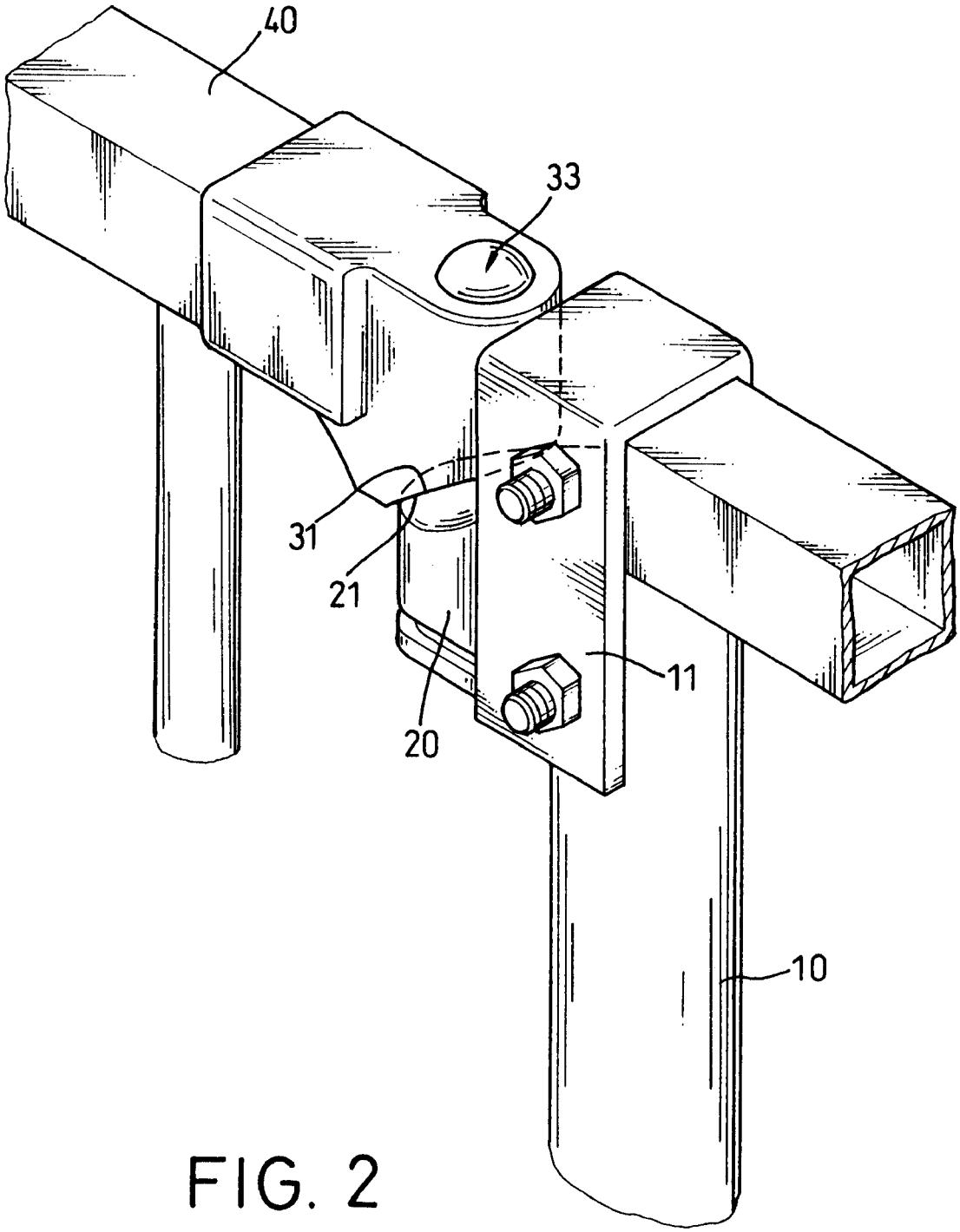
FIG. 2 is an enlarged perspective view of the self-closing safety gate hinge in FIG. 1.
Figure 3:
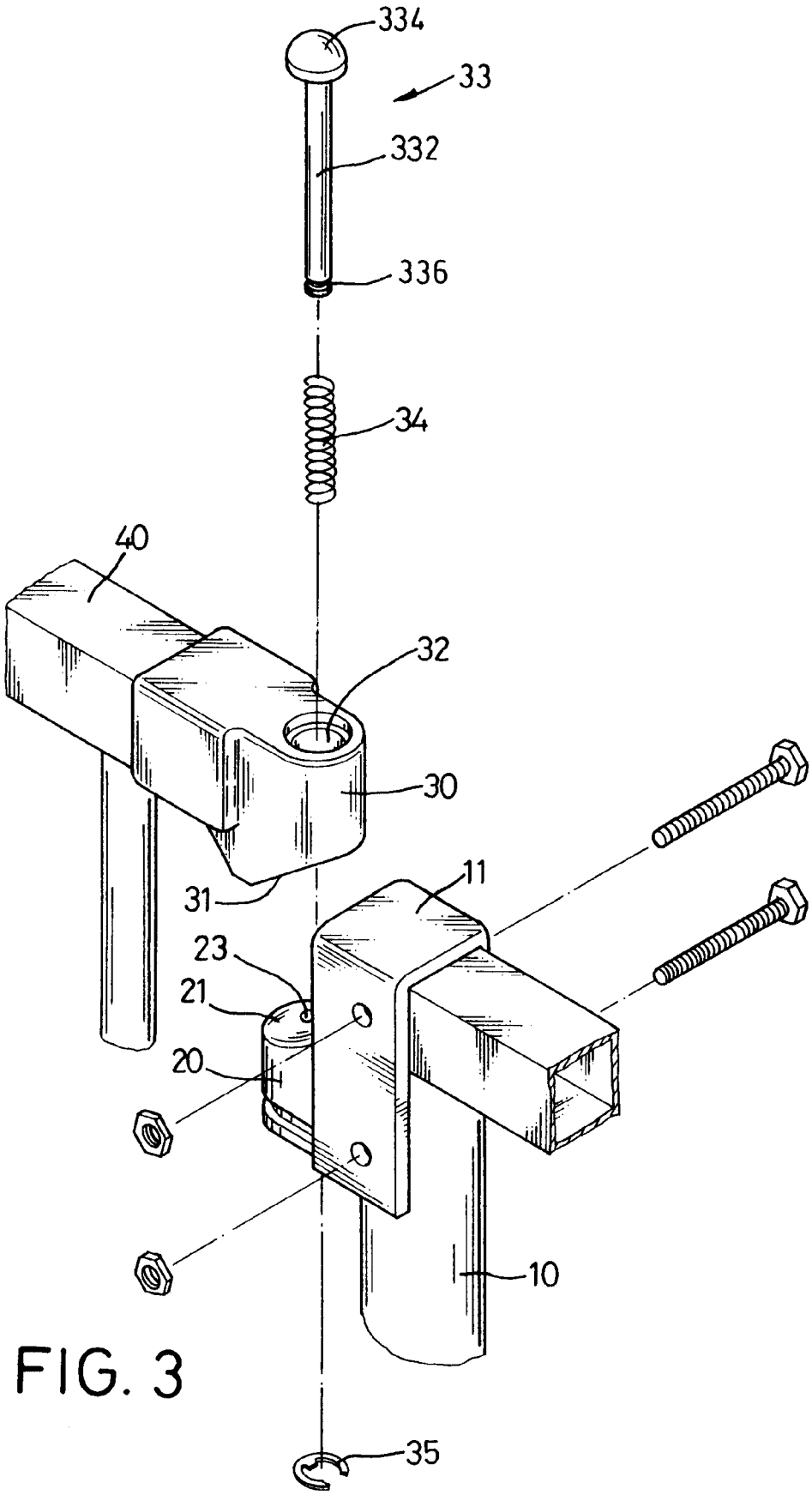
FIG. 3 is an enlarged exploded perspective view of the self-closing safety gate hinge in FIG. 1.
Figure 4:
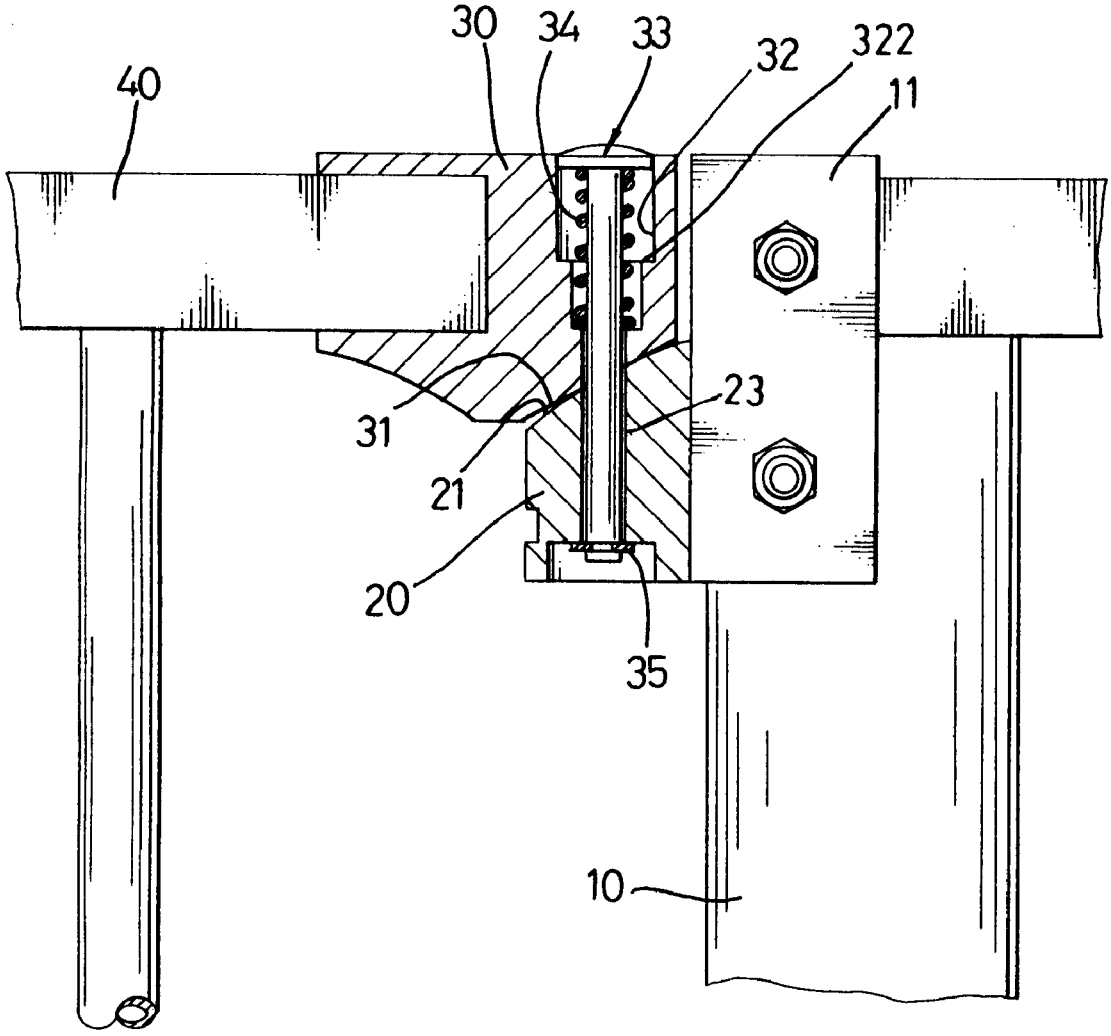
FIG. 4 is an enlarged front plan view in partial section of another embodiment of the self-closing safety gate hinge in accordance with the present invention.

With reference to FIGS. 1 to 4, a self-closing safety gate hinge in accordance with the present invention comprises a bracket (11), a bottom seat (20), a top seat (30), a hinge pin (33) and a spring (34). The self-closing safety gate hinge is connected to a gate post (10) and to a gate body (40). The gate post (10) and the gate body (40) have a top, a bottom, two sides, a front and a back.

The bracket (11) has a side facing the gate body (40) and a side facing the gate post (10) and is attached to the top of the gate post (10). The bottom seat (20) has an inclined top surface (21) and is attached to the side of the bracket (11) facing the gate body (40). The inclined top surface (21) has a center and is cambered from the top to bottom and the front to the back. A vertical through hole (23) is defined through the central of the bottom seat (20).

The top seat (30) is mounted on the top of the gate body (40) at the first side and has an inclined bottom surface (31) to contact the inclined top surface (21) on the bottom seat (20). The inclined bottom surface (31) has a center and is concave to correspond partially to the camber of the inclined top surface (21) of the bottom seat (20). The inclined bottom surface (31) partially contacts with the inclined top surface (21) on the bottom seat (20). A vertical stepped through hole (32) is defined through the top seat (30) through the center of the inclined bottom surface (31). Shoulders (322) are formed at each step in the vertical stepped through hole (32) in the top seat (30). The spring (34) has a top end and a bottom end and is mounted in the vertical stepped through hole (32) such that the bottom end of the spring (34) presses against the lowest shoulder. The hinge pin (33) comprises a shaft (332) with an enlarged head (334) formed on one end of the shaft (332) and an annular groove (336) formed around the other end. The shaft (332) of the hinge pin (33) passes through the spring (34), the stepped through hole (32) in the top seat (30) and the through hole (23) in the bottom seat (21). The diameter of the shaft (332) is smaller than the inner diameter of the stepped through hole (32) or the through hole (23), such that a gap is defined between the shaft (332) and the through holes (23, 32). This will allow that the top seat (30) or the bottom seat (20) can slopingly move relative to the hinge pin (33). The head (334) of the hinge pin (33) presses against the top end of the spring (34). The bottom end of the shaft (332) with the annular groove (336) extends out of the through hole (23) in the bottom seat (20). A C-clip (35) is mounted in the annular groove (336) around the hinge pin (33).

A lock device (41) is mounted on the top of the gate body (40) at the second side and a treadle device (42) is installed below the bottom of the gate body (40) at the second side.

The gate body (40) is locked by the lock device (41) and can not be opened.

Figure 5:
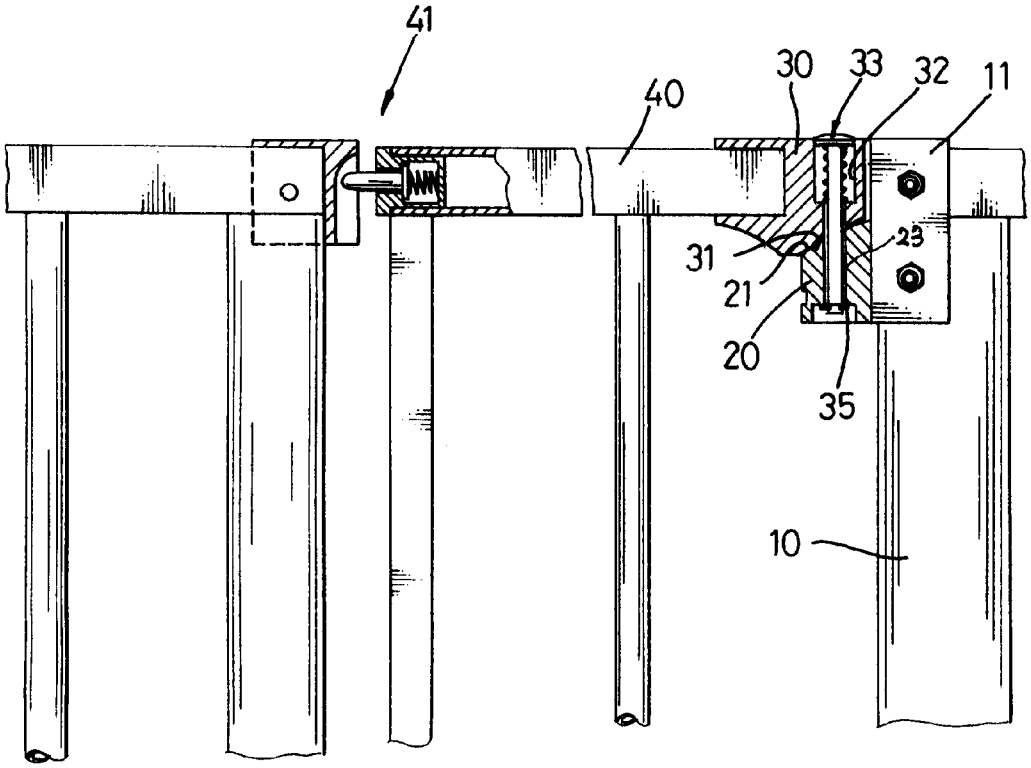
FIG. 5 is an enlarged operational front plan view in partial section of the self-closing safety gate hinge in FIG. 1 when the gate is closed.
Figure 6:
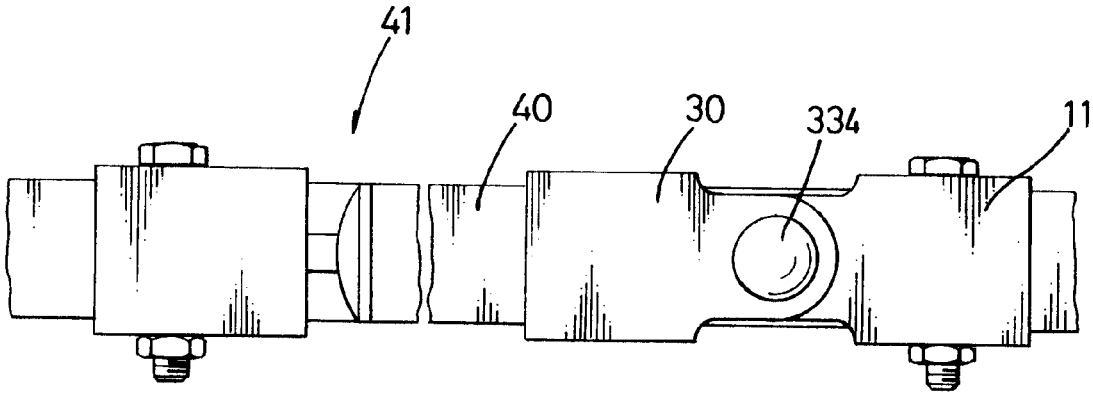
FIG. 6 is an enlarged operational top plan view of the self-closing safety gate hinge in FIG. 1 when the gate is closed.
Figure 7:
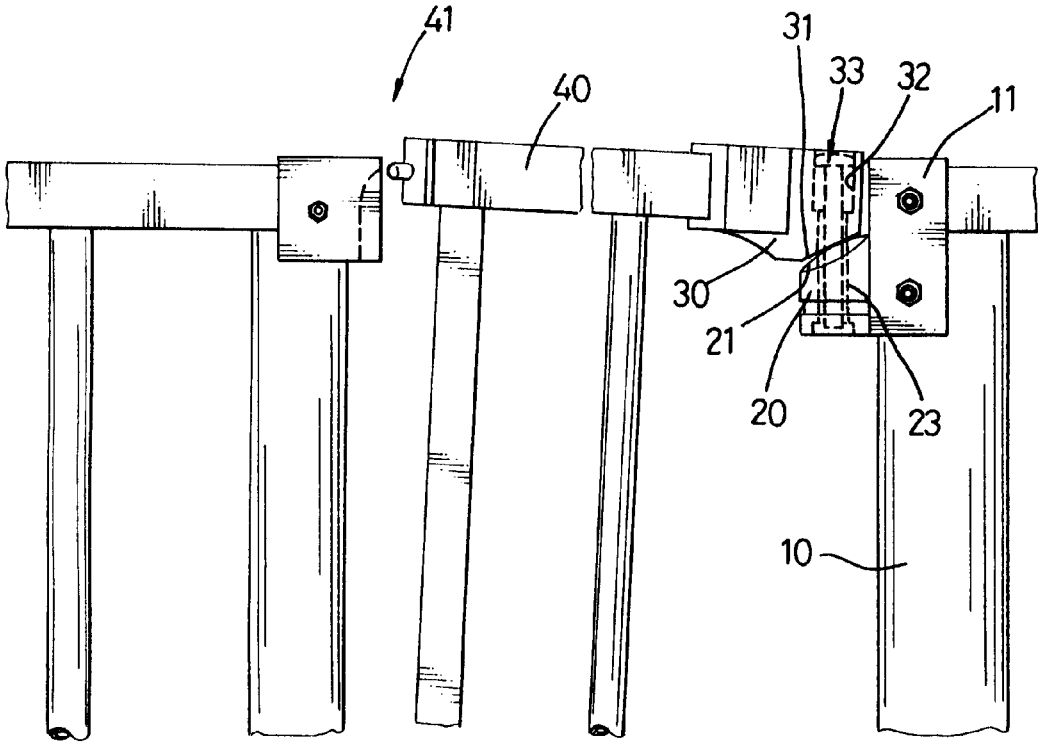
FIG. 7 is an enlarged operational front plan view of the self-closing safety gate hinge in FIG. 1 when the gate is opening.
Figure 8:
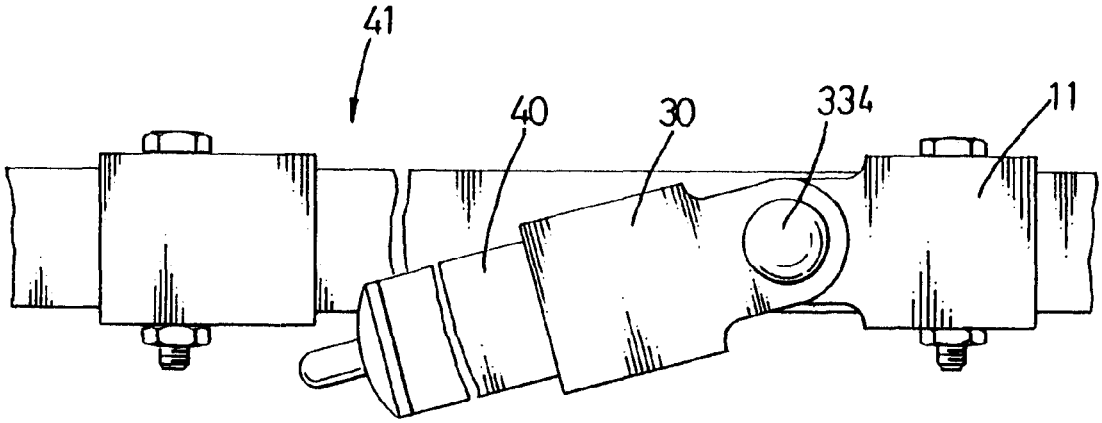
FIG. 8 is an enlarged operational top plan view of the self-closing safety gate hinge in FIG. 1 when the gate is opening.
Figure 9:
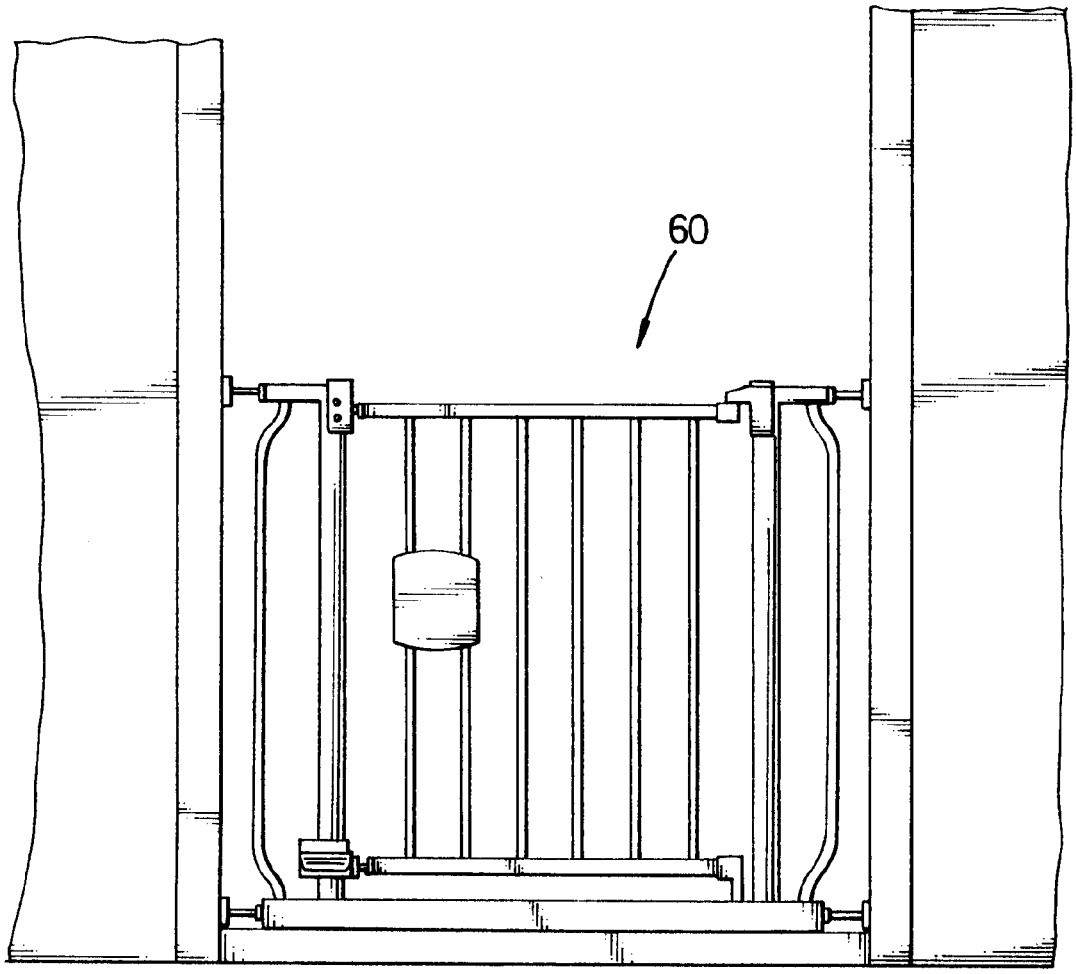
FIG. 9 PRIOR ART
FIG. 9 is a front plan view of a conventional safety gate in accordance with the prior art.

With reference to FIGS. 5 to 8, when the user wants to open the gate, the user must stamp the treadle device (42) or lift the gate body (40) to unlock the lock device (41). Because a force, about five kilograms, is needed for stamping the treadle device (42) or to lifting the gate body (40), a child has not an ability of lifting the gate body (40) so that a protecting effect is provided.

When the user lifts the gate body (40), the top seat (30) will rise to a higher position along the camber of the top surface on the bottom seat (20) because of a gap defined between the shaft (332) and the through holes (23, 32). The inclined surfaces (21, 31) will separate partially from each other so that the lock device (41) will be unlocked and the gate body (40) can be opened. After the user passes through the gate, the gravity is acting on the gate body (40) and the gate body (40) forces the top seat (30) to press against the inclined top surface (21) of the bottom seat (20). The cambered and concave inclined surfaces (21, 31) force the gate body (40) back to a closed position. Consequently, a self-closing safety effect is achieved.

Accordingly, the safety gate with the self-closing safety gate hinge in accordance with the present invention can keep the gate in a normally locked condition. This can prevent the children from pushing the safety gate open inadvertently when they are playing with potentially dangerous and disastrous results. Moreover, when people opens the safety gate and forgets to close it, the safety gate always closes and locks by itself. An infant that will not crawl or walk through the safety gate and the infant is kept in a safer environment.

Although numerous characteristics and advantages of the present invention have been set forth in the foregoing description, together with details of the structure and function of the invention, it will be obvious to those skilled in the art that various modifications may be made without departing from what is intended to be limited solely by the appended claims.

What is claimed is:

1. A self-closing safety gate hinge for a safety gate, the safety gate having a gate body with two sides and a respective gate post with a top and a bottom corresponding to each side of the gate body, the self-closing safety gate hinge comprising:

a bracket with a side adapted to face the gate body and being adapted to be attached to a top of one of the gate posts;

a bottom seat mounted on the side of the bracket and having an inclined top surface, the inclined top surface having a center, and a vertical through hole defined in the bottom seat through the center of the inclined top surface;

a top seat pivotally attached to the bottom seat with a hinge pin and being adapted to be mounted on a top of the gate body, the top seat having an inclined bottom surface partially corresponding to the inclined top surface of the bottom seat, the inclined bottom surface having a center, and a vertical stepped though hole defined in the top seat through the center of the inclined bottom surface, wherein shoulders are formed in the vertical stepped through hole; and a spring mounted around the hinge pin in the vertical stepped through hole, the spring having a bottom end against one of the shoulders and a top end abutting against the hinge pin.

2. The self-closing safety gate hinge as claimed in claim 1, wherein the hinge pin is mounted through the spring, the vertical stepped though hole in the top seat and the vertical though hole in the bottom seat; and the hinge pin has a shaft with a first end and a second end, and an enlarged head formed on the first end of the shaft to abut the top end of the spring, the second end of the shaft extending through the spring.

3. The self-closing safety gate hinge as claimed in claim 2, wherein the second end of the shaft extends through the bottom seat, and an annular groove is formed around the second end of the shaft; and a C-clip is mounted in the annular groove around the hinge pin to hold the hinge pin in the vertical through holes.

4. The self-closing safety gate hinge as claimed in claim 2, wherein the inclined top surface of the bottom seat is cambered from a front to a back and a top to a bottom; and the inclined bottom surface of the top seat is concave and partially corresponds to the inclined top surface of the bottom seat so that the inclined bottom surface partially contacts with the inclined top surface on the bottom seat.

5. The self-closing safety gate hinge as claimed in claim 1, wherein the inclined top surface of the bottom seat is cambered from a front to a back and a top to a bottom; and the inclined bottom surface of the top seat is concave and partially corresponds to the inclined top surface of the bottom seat so that the inclined bottom surface partially contacts with the inclined top surface on the bottom seat.

6. A self-closing safety gate hinge for a safety gate, the safety gate having a gate body with two sides, and two gates posts, each gate post corresponding to a respective side of the gate body, the self-closing safety gate hinge comprising:

a bracket with a side that is adapted to face the gate body and being adapted to be attached to a top of one of the gate posts;

a bottom seat mounted on the side of the bracket and having an inclined top surface, the inclined top surface having a center, and a vertical through hole extending through the bottom seat and being formed at the center of the inclined top surface;

a hinge pin with a shaft having a first end and a second end, and an enlarged head formed on the first end of the shaft;

a top seat pivotally attached to the bottom seat with the hinge pin and being adapted to be mounted on a top of the gate body, the top seat having an inclined bottom surface partially corresponding to the inclined top surface of the bottom seat, the inclined bottom surface having a center, and a vertical stepped through hole extending through the top seat and being formed at the center of the inclined bottom surface, wherein shoulders are formed in the vertical stepped through hole; and a spring mounted around the hinge pin, the hinge pin extending in the vertical stepped through hole in the top seat and the vertical through hole in the bottom seat, the spring having a bottom end disposed against one of the shoulders and a top end abutting against the enlarged head of the hinge pin.

7. A self-closing safety gate hinge for a safety gate, comprising:

a bracket adapted to be attached to a top of a gate post;

a bottom seat connected to the bracket and having an inclined top surface, the inclined top surface having a center, and a vertical through hole extending through the bottom seat and being formed at the center;

a hinge pin having a shaft, and an enlarged head formed on an end of the shaft;

a top seat pivotally attached to the bottom seat using the hinge pin and being adapted to be mounted on a top of a gate body, the top seat having an inclined bottom surface arranged over the inclined top surface of the bottom seat, the inclined bottom surface having a center, and a vertical stepped through hole extending through the top seat and being formed at the center of the inclined bottom surface, the vertical stepped through hole having shoulders formed therein; and a spring mounted around the hinge pin and being disposed in the vertical stepped through hole, with a bottom of the spring abutting against one of the shoulders and a top end of the spring abutting against the enlarged head of the hinge pin, the shaft of the hinge pin extending through the vertical stepped through hole in the top seat and the vertical through hole in the bottom seat.

8. A self-closing safety gate hinge for a safety gate as recited in claim 7, wherein the shaft of the hinge pin is slidably and axially movable through the vertical stepped through hole in the top seat.

* * * * *